US005407737A

United States Patent [19]

Halterbeck et al.

[11] Patent Number: 5,407,737

[45] Date of Patent: Apr. 18, 1995

[54] PAPER MACHINE COVER, IN PARTICULAR A DRYING FILTER

[75] Inventors: Walter Halterbeck; Martin Huser, both of Duren, Germany

[73] Assignee: Thomas Josef Heimbach GmbH & Co., Duren, Germany

[21] Appl. No.: 976,917

[22] Filed: Nov. 18, 1992

[30] Foreign Application Priority Data

Nov. 19, 1991 [DE] Germany ..... 41 37 984.5

[51] Int. Cl.[6] ..... D03D 3/00

[52] U.S. Cl. ..... 428/229; 139/383 A; 428/224; 428/225; 428/234; 428/257; 428/300; 264/175

[58] Field of Search ..... 428/224, 225, 229, 257, 428/300, 234; 139/383 A; 162/DIG. 1; 264/175

[56] References Cited

U.S. PATENT DOCUMENTS

| | | | |
|---|---|---|---|
| 4,656,073 | 4/1987 | Harris | 428/229 |
| 4,969,322 | 11/1990 | Sasaki et al. | 428/229 |
| 5,097,872 | 3/1992 | Laine et al. | 428/229 |
| 5,116,478 | 5/1992 | Tate et al. | 428/229 |
| 5,117,865 | 6/1992 | Lee | 428/229 |

FOREIGN PATENT DOCUMENTS

| | | |
|---|---|---|
| 191231 | of 1985 | European Pat. Off. . |
| 1444115 | of 1968 | Germany . |
| 980288 | of 1965 | United Kingdom . |
| 2097435 | of 1982 | United Kingdom . |

*Primary Examiner*—James J. Bell
*Attorney, Agent, or Firm*—Joseph W. Berenato, III

[57] ABSTRACT

A paper machine cover with a textile web structure, e.g., a woven, knitted, or non-woven fabric, etc., is provided. The paper machine cover has flattened threads, whereby respectively the longer axis of the cross-section of these threads extends parallel to the plane of the paper machine cover. The flattened threads consist of monofilaments with an annular cross-section and/or multifilaments formed of individual filaments with an annular cross-section. The monofilaments or individual filaments of the multifilaments have an annular cross-section. These filaments are deformed plastically into the flattened cross-section at least in those areas where they extend parallel to the plane of the paper machine cover.

20 Claims, 1 Drawing Sheet

PAPER MACHINE COVER, IN PARTICULAR A DRYING FILTER

Figure 1:
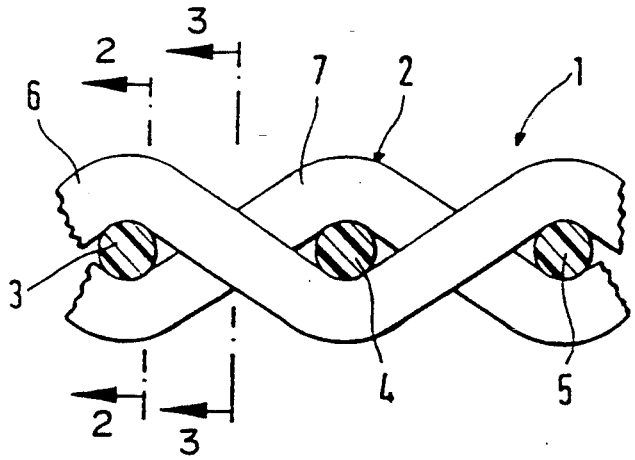
Figure 2:
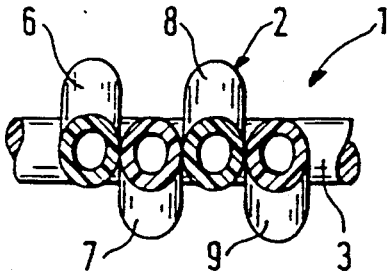
Figure 3:
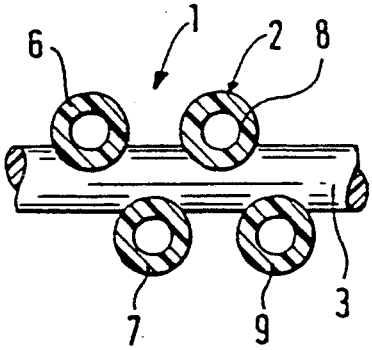

The invention relates to a paper machine cover, in particular a dryer screen, with, or consisting of, a textile web structure, e.g. a woven, knitted, or non-woven fabric, which has threads with a flattened cross-section, whereby respectively the longer axis of the cross-section of these threads extends parallel to the plane of the paper machine cover.

Paper machine covers are very long and considerably wide textile material webs which are used for the forming and guiding, as well as transport of the paper web through the individual sections of the paper machine, i.e. essentially the sheet forming section, the press section, and the drying section. Hereby the textile web structure for the material web consists mostly of woven fabrics which are especially adapted in their weave structure to the respective requirements in the individual sections of the paper machine. Sometimes these woven fabrics are also coated and needled with fiber batts on one or both sides in order to achieve felt-like surfaces. In place of a woven fabric it is also possible to use other web structures, e.g. warp knit fabrics or non-woven fabrics.

The web structure of a paper machine cover is made of monofilaments or multifilaments consisting of individual filaments. Suitable materials for this purpose are almost exclusively thermoplastic polymers, especially polyamides, polyesters, etc. As a rule, the monofilaments or the individual filaments of the multifilaments are massive and have a diameter of 0.1 mm and above. In most cases, the cross-section is circular.

But the state of technology also includes paper machine covers with a web structure containing non-circular threads (U.S. Pat. No. 3,858,623). Hereby it was found to be particularly advantageous for the use especially in the drying section of paper machines, that flattened threads are used whose longer cross-section axis extends parallel to the plane of the paper machine cover. Primarily, it was proposed that only the longitudinal threads extending in machine direction of the paper machine cover are shaped in a flattened manner (compare e.g. U.S. Pat. No. 2,003,123, U.S. Pat. No. 3,139,119, U.S. Pat. No. 3,545,705, U.S. Pat. No. 3,632,068, U.S. Pat. No. 4,142,557 German OS 28 47 327, U.S. Pat. No. 4,351,874, GB Patent 2 097 435). However, also known are paper machine covers where the longitudinal and transverse threads consist of flattened wires, e.g. in the case of non-woven metal filament fabrics (U.S. Pat. No. 3,164,514, U.S. Pat. No. 3,309,265), but also in woven metal fabrics (U.S. Pat. No. 3,346,465). The same is known for woven fabrics of plastic filaments (GB Patent 980 288).

The use of flattened threads has significant advantages, especially when used as a dryer screen. The dryer screen may be constructed less thick, resulting in better heat transfer from the heating rolls to the paper web. Furthermore, the material density within the dryer screen is greater than when circular threads are used, so that air permeability is reduced. Of course, a too high air permeability causes significant air movement to take place through the dryer screen, which may result in fluttering of the dryer screen.

The production of paper machine covers with thread systems containing flattened threads is difficult, since the threads hereby must not be allowed to twist. The twisting tendency affects especially the weft threads. The state of technology offers no usable solutions for preventing twisting of the threads.

The invention therefore has the task of designing a paper machine cover of the initially mentioned type in such a way that it is ensured that flattened threads are always oriented in such a way that the respectively longer axis of the thread cross-section extends parallel to the plane of the paper machine cover. The object of the invention is also a process for producing such a paper machine cover.

According to the invention this task is solved in that the flattened threads consist of monofilaments with an annular cross-section and/or multifilaments formed of individual filaments with an annular cross-section, whereby the monofilaments or individual filaments of the multifilaments which have an annular cross-section are deformed plastically into the flattened cross-section at least in those areas whereby they extend parallel to the plane of the paper machine cover.

According to the invention, such a paper machine cover may be produced in such a way that monofilaments with a hollow cross-section and/or multifilaments consisting of individual filaments with a hollow cross-section are used for the textile web structure, and that the web structure equipped in this way, or consisting of them, is subject to such a pressure and heat treatment that the mono- or multifilaments are plastically deformed into the flattened cross-section at least in those areas where they extend essentially parallel to the plane of the paper machine cover.

This process thus uses initially hollow monofilaments and/or multifilaments with hollow individual filaments to form the textile web structure, so that the orientation in which they are incorporated or woven into the textile web structure does not matter. Deformation into a flattened cross-section then is performed using a pressure and heat treatment, e.g. calendering, by passing the finished thread system between one or more pairs of heated rolls. In this way the hollow monofilaments or multifilaments with hollow individual filaments are plastically deformed and in this manner attain a flattened cross-section. This means that standard machines can be used to produce the textile web structure. The pressure and heat treatment also makes it possible to realize extremely thin paper machine covers, in particular dryer screens, which ensure a very good heat transfer and furthermore have such a density within the thread system that the air permeability and thus the tendency to flutter is only low. In addition, the weight of such a paper machine cover can be reduced.

It is certainly known in paper machine covers, to equip the thread system which is present in woven form with hollow monofilaments. Such monofilaments represented the state of technology, but were initially employed in other fields of technology (compare U.S. Pat. No. 2,399,259 and U.S. Pat. No. 3,772,137). According to U.S. Pat. No. 4,251,588, a paper machine cover equipped with such hollow filaments promises a better dimensional stability than one equipped with massive monofilaments, especially under deformation loads as they occur in the press section, and also a higher degree of bonding among the threads themselves, a longer-lasting flexibility, and overall an improved life span. The use of hollow plastic weft threads is also found in German OS 28 47 327.

Also known in the use of hollow fibers as carriers for a treatment fluid in paper machine covers (European Patent Application A10 191 231). During operation of the paper machine cover, this treatment fluid exits via openings, e.g. at the end of the fibers, in particular to bring about a cleaning effect. Hereby the fibers are parts of textile fibers, multifilaments, or needled-on fiber batts.

When using hollow monofilaments, an express warning against flattening of the fiber cross-sections has been issued (see U.S. Pat. No. 4,251,588), so that the hollow monofilaments described in this document only have a small hollow volume in the magnitude from 3 to 15% of the overall cross-section.

In a development of the invention it is provided that the monofilaments or filaments of the multifilaments with their annular cross-section are deformed in such a way that they contact each other with their insides, i.e. they are maximally flattened in order to achieve the thinnest possible thread system.

To the extent that the paper machine cover consists of the textile web structure, a use as a dryer screen is particularly suitable. In principle, the invention also may be used for all other types of paper machine cover. To the extent that the paper machine cover is intended as press felt, it is possible to needle the textile web structure with the flattened filaments on one or both sides in an actually known manner to a fiber batt, so that the fabric acquires a felt-like surface on one or both sides.

As a rule, the annular monofilaments or multifilaments with annular individual filaments which have been deformed according to the invention may be incorporated into the thread system both in longitudinal and transverse direction. However, significant advantages are achieved even if these monofilaments or multifilaments extend only in one direction of the paper machine cover, namely—if the thread system is woven flat—especially in the transverse direction. It is then possible to use thread with a circular cross-section in longitudinal direction. But it is also possible to use massive flattened wires, since weft threads are easier prevented from twisting than warp threads in a loom.

To the extent that the paper machine cover has, or consists of, a web structure in the form of a woven fabric, it was found to be advantageous that the woven fabric has an identical weave on both sides, i.e., is construed symmetrically in this respect.

An advantageous further development of the process according to the invention consists of using as starting material for the web structure hollow monofilaments and/or hollow filaments for the multifilaments which have a circular cross-section on the outside and inside prior to being plastically deformed. It does not matter in what orientation they are incorporated into the thread system.

Furthermore, the invention proposes that hollow monofilaments or hollow individual filaments for the multifilaments, which have a free cross-section area from 20 to 80%, preferably 40 to 60%, of the overall cross-section area are used. Especially thin-walled monofilaments or filaments make it possible to achieve greatly flattened thread cross-sections, whereby the wall thinness is limited by the forces which must be absorbed in each case.

The drawing shows the invention in more detail using an embodiment.

Figure 4:
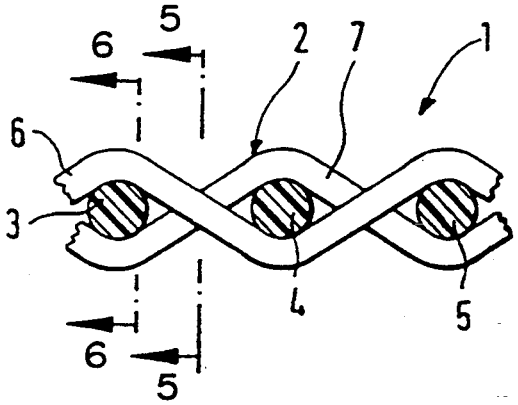
Figure 5:
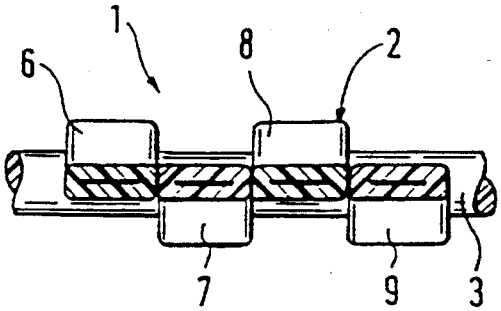
Figure 6:
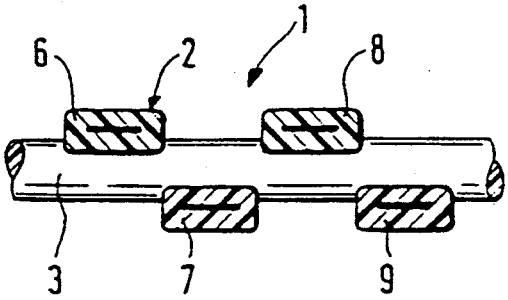

FIG. (1) shows a partial longitudinal section through a paper machine cover parallel to its machine direction;

FIG. (2) shows a partial cross-section through the paper machine cover according to FIG. (1) in plane 2—2 (FIG. 1);

FIG. (3) shows a partial cross-section through the paper machine cover according to FIG. (1) in plane 3—3 (FIG. 1);

FIG. (4) shows a partial longitudinal section through the paper machine cover according to FIGS. (1) to (3) after a calendering treatment;

FIG. (5) shows a cross-section through the paper machine cover according to FIG. (4) in plane 5—5 (FIG. 4);

FIG. (6) shows a partial cross-section through the paper machine cover according to FIG. (4) in the plane 6—6 (FIG. 4).

The dryer screen (1) shown in the figures is intended for the drying section of a paper machine. It consists of a woven fabric (2) which in this case is manufactured only as an example in linen weave and which has transverse threads (3, 4, 5) extending in transverse direction, i.e. transversely to the intended machine direction of the dryer screen (1), and longitudinal threads (6, 7, 8, 9) extending longitudinally to the machine direction.

The transverse threads (3, 4, 5) pass in a relatively straight manner through the body of the woven fabric (2) and are construed as massive monofilaments. During the production of the woven fabric (2), hollow monofilaments with an annular cross-section have been used for the longitudinal threads (6, 7, 8, 9), as is shown in particular in FIGS. (2) and (3). Hereby the longitudinal threads (6, 7, 8, 9) initially have a circular cross-section on the inside and outside and tie up the transverse threads (3, 4, 5).

Following the weaving process, the woven fabric (2) undergoes a calendering treatment by being passed through pairs of calendering rolls which are pressing against each other, whereby this calendering treatment may be repeated several times. Because of this calendering treatment the flat sides of the woven fabric (2) undergoes a simultaneous pressure and heat treatment. As a result, the longitudinal threads (6, 7, 8, 9) which are formed by hollow monofilaments are pressed flat, i.e. receive an almost rectangular cross-section, whereby the insides of the longitudinal threads (6, 7, 8, 9) come to rest on top of each other, as is shown particularly in FIGS. (5) and (6).

When comparing FIGS. (1) and (4), it becomes clear that the thickness of the dryer screen (1) is significantly decreased due to the flattening of the longitudinal threads (6, 7, 8, 9). The thickness could be additionally reduced by also using hollow monofilaments for the transverse threads (3, 4, 5).

We claim:

1. Paper machine cover with, or consisting of, a textile web structure, which is one of a woven, knitted, or non-woven fabric which has flattened threads, whereby respectively the longer axis of the cross-section of these threads extends parallel to the plane of the paper machine cover, characterized in that the flattened threads (6, 7, 8, 9) consist of monofilaments with an annular cross-section and/or multi filaments formed of individual filaments with an annular cross-section, whereby the monofilaments or individual filaments of the multifilaments which have an annular cross-section are deformed plastically into the flattened cross-section at least in those areas where they extend parallel to the plane of the paper machine cover (1).

2. Paper machine cover according to claim 1, characterized in that the monofilaments ( 6, 7, 8, 9 ) or individual filaments of the multifilaments which have an annular cross-section are deformed in such a way that their insides contact each other.

3. Paper machine cover according to one of claim 1, characterized in that the textile web structure is needled on one or both sides to a fiber batt.

4. Paper machine cover according to claim 1, characterized in that the annular monofilaments or multifilaments with annular individual filaments extend only in transverse direction of the paper machine cover (1).

5. Paper machine cover according to claim 1, characterized in that the paper machine cover (1) has, or consists of, a web structure in the form of a woven fabric (2), and that the woven fabric (2) has an identical weave on both sides.

6. A paper machine cover, comprising:

a) a textile web structure comprising threads, said threads having a longitudinal axis extending in the machine direction; and b) said threads having a generally rectangular cross-section and an inner surface and an outer surface, said inner surface having a first portion and second portion in direct contact with said first portion.

7. A paper machine cover according to claim 6, wherein:

a) said textile web structure is one of a woven fabric, a knitted fabric and a non-woven fabric; and b) said threads are one of a monofilament and a multifilament.

8. A paper machine cover according to claim 7, wherein:

a) said textile web structure is symmetrical about a plane extending through a central axis of each of said threads and extending in the machine direction.

9. A paper machine cover according to claim 6, wherein:

a) the width of at least one thread is greater than the height of said at least one thread.

10. A paper machine cover according to claim 6, further comprising:

a) a fiber batt; and b) said textile web structure is needled on at least one side to said batt.

11. A paper machine cover according to claim 6, wherein:

a) said textile web structure includes threads extending in a direction transverse to the machine direction, said threads having an annular cross-section and forming a hollow interior space.

12. Process for producing a paper machine cover according to claim 1, characterized in that hollow monofilaments (6, 7, 8, 9) and/or multifilaments with hollow individual filaments used as a starting material for the textile web structure are plastically deformed by the application of pressure and heat into the flattened cross-section at least in those areas where they extend essentially parallel to the plane of the paper machine cover.

13. Process according to claim 12, characterized in that hollow monofilaments (6, 7, 8, 9) and/or hollow individual filaments for the multifilaments which have a circular cross-section on the outside and inside are used as starting material for the web structure (2).

14. Process according to claim 13, characterized in that the hollow monofilaments (6, 7, 8, 9) or the individual filaments of the multifilaments have a free inside area of the cross-section which makes up between 20 and 80%, preferably 40 to 60% of the total cross-section area.

15. Process according to claim 12, characterized in that the hollow monofilaments or the multifilaments with hollow individual filaments are incorporated into the thread system (2) only in the transverse direction of the paper machine cover (1).

16. Process according to claim 12, characterized in that the thread system (2) is calendered for the pressure and heat treatment.

17. A process for producing a paper machine cover, comprising the steps of:

a) providing a textile web structure comprising threads having an annular cross-section; and b) deforming the threads plastically and permanently so that the threads have a generally rectangular cross-section.

18. A process according to claim 17, including the step of:

a) providing a textile web structure which is one of a woven fabric, a knitted fabric, and a non-woven fabric;

b) providing threads which are one of a monofilament and a multifilament; and c) needling the textile web structure on at least one side to a fiber batt.

19. A process according to claim 17, wherein said deforming step includes the step of:

a) applying heat and pressure so that at least the threads which extend in the machine direction are plastically deformed into a generally rectangular cross-section.

20. A process according to claim 18, including the step of:

a) providing threads initially having an annular cross-section in which the hollow area is between 20 and 80%, and preferably 40 to 60% of the total cross-sectional area.

* * * * *